United States Patent [19]

Huber

[11] Patent Number: 4,927,382

[45] Date of Patent: May 22, 1990

[54] ELECTRICAL FUNCTION GROUP FOR A VEHICLE

[75] Inventor: Anton Huber, Regensburg, Fed. Rep. of Germany

[73] Assignee: Siemens Aktiengesellschaft, Berlin and Munich, Fed. Rep. of Germany

[21] Appl. No.: 249,763

[22] Filed: Sep. 21, 1988

[30] Foreign Application Priority Data

Nov. 3, 1987 [DE] Fed. Rep. of Germany ..... 3737289

[51] Int. Cl.[5] ..... H01R 3/00

[52] U.S. Cl. ..... 439/490; 439/924; 340/687

[58] Field of Search ..... 439/315, 489, 490, 488, 439/188, 189, 43, 49, 52, 924; 340/686, 687

[56] References Cited

U.S. PATENT DOCUMENTS 3,960,428 6/1976 Naus et al. ..... 439/315
4,084,875 4/1978 Yamamoto ..... 439/490 X
4,346,419 8/1982 Janniello ..... 361/2

FOREIGN PATENT DOCUMENTS 3212983 11/1982 Fed. Rep. of Germany .

*Primary Examiner*—Neil Abrams
*Assistant Examiner*—Khiem Nguyen
*Attorney, Agent, or Firm*—Hill, Van Santen, Steadman & Simpson

[57] ABSTRACT

In an electrical function group, a useful circuit having electrical module units is electrically connected via a plug-type connector. The plug-type connector is equipped with a longer and with a shorter contact pin, so that the shorter contact pin separates first when the plug-type connector comes apart. The longer contact pin is a useful contact that closes the useful circuit and the shorter contact pin is a signal contact that closes a signal circuit. The signal circuit contains a monitoring arrangement that generates an alarm when the signal circuit is parted by the signal contact. As a result thereof, an incipient parting event of the plug-type connector is recognized before the useful circuit is separated.

4 Claims, 1 Drawing Sheet

ELECTRICAL FUNCTION GROUP FOR A VEHICLE

BACKGROUND OF THE INVENTION

The invention is directed to an electrical function group for a vehicle comprising a useful circuit that contains at least two electrical module units that are connected via at least one electrical plug-type connector comprising a plug part and a socket part whereby the plug part has at least one useful contact comprising a longer contact pin and at least one signal contact comprising a shorter contact pin, and the socket part has at least two contact sleeves for frictional acceptance of the contact pins.

Numerous electrical modular units are situated in vehicles and are electrically connected to one another via plug-type connectors. For example, this can be an incandescent lamp that is connected to a voltage source via a plug-type connector.

When such a plug-type connector comes apart, then the electrical modular units connected thereover are no longer functional. Given safety-related systems such as, for example, a motor vehicle air bag trigger circuit, this represents a risk for the persons conveyed therein. In other systems such as ignition control devices for internal combustion engines, motor damage can occur that involves expensive repair work.

In order to counter these risks, a continuous operational monitoring of such systems is not adequate, since a plug-connector that has in fact come apart is immediately recognized but the disadvantageous effects thereof have already occurred.

SUMMARY OF THE INVENTION

An object of the present invention is to monitor an electrical plug-type connector such that a parting event of the plug-type connector is recognized before the actual useful circuit that connects the electrical module units to one another is parted.

This object is achieved by the present invention in that a signal circuit that contains a monitoring means is conducted via the signal contact and in that the monitoring means generates an alarm given an interruption of the signal circuit due to a parting of the signed contact.

The solution of the invention uses a plug-type connector that is composed of a plug part comprising contact pins and a socket part comprising contact sleeves for the acceptance of the contact pins. The plug part has at least one useful contact that is composed of a long contact pin via which the electrical module units are connected in a useful circuit. In addition, the plug part has at least one signal contact that is composed of a short contact pin. When the plug-type connector is placed together, thus, the useful contacts come into electrical communication with the corresponding contact sleeves of the socket part before the signal contact. With the plug-type connector parts, by contrast, the signal contact separates before the useful contacts.

Such a plug-type connector is known from other technological fields. German published application No. 32 12 983 discloses a detachable plug that comprises two long high-tension current contact pins, this power current circuit being switched on and off via the low-tension current contact pin with the assistance of a semiconductor switch. The formation of an arc when the plug is parted is thereby prevented since the power circuit is already disconnected before the high-tension power contact pins separate.

In the inventive application of such a plug-type connector, there is no interactive connection of the circuits conducted via the short signal contact and the long useful contact. Here, the short signal contact is part of a signal circuit that contains a monitoring means that checks whether the signal circuit is closed via the signal contact. When this is not the case, then the monitoring circuit outputs an alarm. This can be optically or acoustically displayed, so that the operator of the motor vehicle is made aware of the parting plug-type connector before the useful circuit is interrupted.

BRIEF DESCRIPTION OF THE DRAWINGS

The invention shall be set forth with reference to the figures; shown are.

DESCRIPTION OF THE PREFERRED EMBODIMENTS

Figure 1:
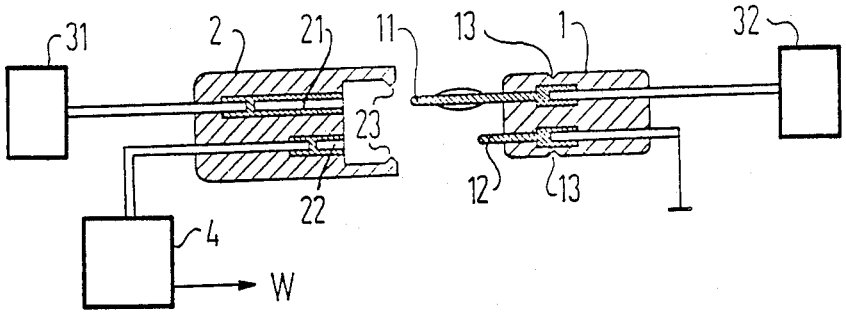
FIG. 1 is an electrical function group constructed in accordance with the principles of the present invention.

FIG. 1 shows a useful circuit comprising two electrical module units 31, 32, this useful circuit being closed via lines, and an electrical plug-type connector composed of a plug part 1 and of a socket part 2 that is shown in its parted condition.

The electrical module units 31, 32 represent arbitrary electrical parts of units used in vehicles that are electrically connected to one another via plug-type connectors.

The plug part 1 of the plug-type connector has a long useful contact 11 that is accepted by a correspondingly long contact sleeve 21 of the socket part 2 when the plug-type connector is placed together. When placed together, retaining noses 23 of the socket part 2 engage over the plug part 1 and catch in corresponding notches 13 of the plug part 1 in the closed position.

The plug part 1 also has a signal contact 12 that is shorter than the useful contact 11 and that is accepted by a contact sleeve 22 of the socket part 2 in the closed position of the plug-type connector. A signal circuit is closed via this signal contact 12, whereby the signal contact 12 is connected to ground and the contact sleeve 22 is connected to a monitoring means 4. The monitoring means 4 is a microprocessor that continuously checks whether the ground potential is adjacent via the plug-type connector.

When the plug-type connector comes apart, the signal contact 12 first separates out of the contact sleeve 22 of the socket part 2. As a result thereof, the grounded potential is no longer adjacent at the microprocessor and the latter generates an alarm W. This alarm W effects the lighting of a warning lamp (not shown in FIG. 1) that draws the attention of the vehicle operator to the separating plug-type connector. The operator can then perform appropriate operations before the useful circuit is separated via the long useful contact 11.

Given a plurality of plug-type connectors to be monitored, the individual signal contacts 12 can be interconnected in series in a signal circuit. A separate input to the microprocessor is therefore not required for every plug-type connector.

Figure 2:
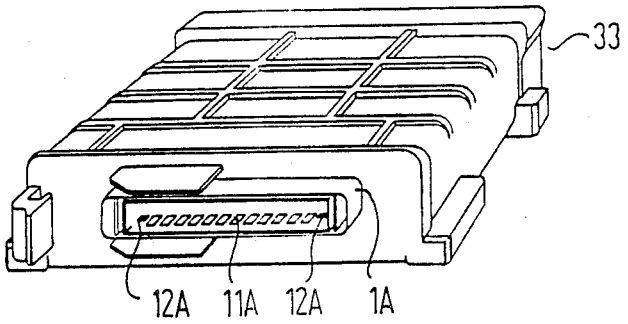
FIG. 2 is an electrical module unit including a plug part constructed in accordance with the principles of the present invention.

As electrical module unit 33, FIG. 2 shows a control device comprising a plug part 1A attached to the housing. The useful contacts 11A here are arranged side-by-side as blade contacts in the form of a blade strip. Respective signal contacts 12A likewise fashioned as blade contacts are situated to the right and left next to the useful contacts 11A. The signal contacts 12A are connected to the same signal circuit in series. If, for example, only the left-hand signal contact 12A in FIG. 2 were present, then a parting of the plug-type connector due to oblique pull-off would not be recognized in time. If, namely, a plug-on socket part were shorn off toward the left by a mechanical influence, then the electrical connection would already be parted, particularly given the useful contacts 11A lying at the right, before the signal contact 12A lying at the left would part. This, however, is prevented by arranging a signal contact 12A at each side of the plug part 1A.

Figure 3:
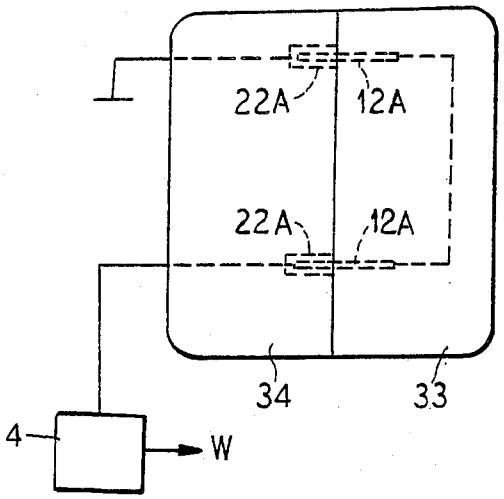
FIG. 3 is a schematic circuit diagram of two electrical modules of the type shown in FIG. 2 connected together.

In FIG. 3, the module 33 is schematically shown connected to a mating module 34 having contact sleeves 22A in which the contact pins 12A are respectively received. The useful contact pins and sleeves are omitted for clarity. As can be seen, a series circuit is formed between ground and the monitoring means 4, so that if either of the signal contact connections is parted, the series circuit will be interrupted and the monitoring means 4 will no longer be connected to ground, thereby causing the alarm W to be generated.

The employment of two or more signal contacts 12A is not limited only to the embodiment of FIG. 2. Multipole, concentric plug-and-socket connectors of a symmetrically shaped plug-type connector can likewise be monitored. The arrangement of the individual signal contacts 12A is thereby dependent on the geometry of the plug-type connector. These are arranged at a distance from one another such that, given a parting of the plug-type connector due to a canted pull-off, the electrical connection of one of the signal contacts 12A is interrupted first in every case.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim:

1. An electrical function group for a vehicle comprising a useful circuit that contains at least two electrical module units that are connected via a plurality of electrical plug-type connectors each comprising a plug part and a socket part whereby said plug part has at least one useful contact comprising a longer contact pin and at least one signal contact comprising a shorter contact pin, and said socket part has at least two contact sleeves for frictional acceptance of said contact pins, and further comprising a signal circuit being conducted serially through said plurality of electrical plug-type connectors that contains a monitoring means being conducted via the signal contact, said monitoring means generating an alarm given an interruption of said signal circuit due to a parting of the signal contact in any one of said plug-type connectors.

2. An electrical function group according to claim 1, wherein said monitoring means comprises a microprocessor.

3. An electrical function group for a vehicle comprising:

a useful circuit containing at least two modules connected by a plurality of plug-type connectors;

said connectors each having a plug part with a long useful circuit pin and a short signal pin and a socket part with a contact sleeve for frictionally receiving each of said pins;

a signal circuit containing a monitoring means and a reference potential connected serially by said plurality of plug-type connectors, and an alarm means operated by said signal circuit upon a detection by said monitoring means of a break in the connection between said monitoring means and said reference potential.

4. An electrical arrangement for a vehicle comprising at least one useful circuit connecting two electrical module units via a respective electrical plug-type connector, the plug-type connector comprising a plug part and a socket part, said plug part having two spaced signal contacts and at least one useful contact disposed between said signal contacts, said useful contact comprising a longer contact pin and said two signal contacts each comprising a shorter contact pin, and said socket part having at least three contact sleeves for frictional acceptance of said contact pins, said arrangement further comprising a signal series circuit including a monitoring means for generating an alarm and said signal contacts and the respective sleeves in which said signal contacts are accepted, said monitoring means generating an alarm given an interruption of said signal series circuit due to a parting of either of said signal contacts.

* * * * *